US006918860B1

(12) United States Patent
Nusbaum

(10) Patent No.: US 6,918,860 B1
(45) Date of Patent: Jul. 19, 2005

(54) EXERCISE BICYCLE VIRTUAL REALITY STEERING APPARATUS

(76) Inventor: Neil H. Nusbaum, 4413 Keystone Ave., Culver City, CA (US) 90232

( * ) Notice: Subject to any disclaimer, the term of this patent is extended or adjusted under 35 U.S.C. 154(b) by 194 days.

(21) Appl. No.: 10/601,421

(22) Filed: Jun. 23, 2003

Related U.S. Application Data

(60) Provisional application No. 60/409,300, filed on Sep. 10, 2002.

(51) Int. Cl.[7] ..... A63B 69/16

(52) U.S. Cl. ..... 482/57; 463/37

(58) Field of Search ..... 482/8, 3, 900, 482/901, 57–65; 434/61; 273/148 B; 345/156; 463/36–38, 48

(56) References Cited

U.S. PATENT DOCUMENTS

| | | | | |
|---|---|---|---|---|
| 4,512,567 A | | 4/1985 | Phillips | |
| 4,542,897 A | | 9/1985 | Melton et al. | |
| 4,630,817 A | * | 12/1986 | Buckley | 463/37 |
| 4,637,605 A | | 1/1987 | Richie | |
| 4,709,917 A | * | 12/1987 | Yang | 482/63 |
| 4,976,435 A | | 12/1990 | Shatford et al. | |
| 5,056,787 A | * | 10/1991 | Mitsuyoshi | 273/148 B |
| 5,591,104 A | | 1/1997 | Andrus et al. | |
| 5,645,513 A | | 7/1997 | Haydocy et al. | |
| 5,829,745 A | * | 11/1998 | Houle | 273/148 B |
| 5,839,990 A | | 11/1998 | Virkkala | |
| 6,159,099 A | * | 12/2000 | Chen | 463/37 |
| 6,251,015 B1 | * | 6/2001 | Caprai | 463/36 |
| 6,561,952 B2 | * | 5/2003 | Wu | 482/3 |
| 6,712,737 B1 | * | 3/2004 | Nusbaum | 482/8 |
| 2003/0171190 A1 | * | 9/2003 | Rice | |

* cited by examiner

*Primary Examiner*—Justine R. Yu
*Assistant Examiner*—Tam Nguyen
(74) *Attorney, Agent, or Firm*—Gordon K. Anderson

(57) ABSTRACT

A steering apparatus for altering steering direction of an exercise bicycle utilizing an interactive computer or television video game simulation which consists of a steering mechanism primary frame (22) that includes a steering tube (24) and a steering plate (26). The steering tube is disposed within an exercise bicycle frame head. A steer frame (58) is rotatably mounted within the primary frame and utilizes a pair of springs (60) that are suspended between the primary frame and the steer frame. Changing steering direction by rotation of the handlebar (70) attached to the steer frame creates progressively linear resistance to the handlebar movement. The steer frame returns to a centered position when unrestrained, duplicating the feel and impression of riding a bicycle. A potentiometer (32) interfaces with the rotating steer frame providing variable electrical resistance relative to the directional movement of the steer frame to the primary frame. An electrical signal is transmitted from an interactive computer or television video game to the potentiometer which interprets the actual steering position of the exercise bicycle.

14 Claims, 5 Drawing Sheets

EXERCISE BICYCLE VIRTUAL REALITY STEERING APPARATUS

CROSS REFERENCE TO RELATED APPLICATION

This application claims priority of Provisional Patent Application Ser. No. 60/409,300 filed Sep. 10, 2002.

TECHNICAL FIELD

The present invention relates to exercise or stationary bicycles in general. More specifically to a steering mechanism for use in a virtual reality system simulating handlebar movement with spring loaded return to center capability.

BACKGROUND ART

Previously, many types of exercise bicycles have been used in endeavoring to provide entertainment while exercising using video games or television set top consoles as an incentive.

The prior art listed below did not disclose patents that possess any of the novelty of the instant invention; however the following U.S. patents are considered related:

| U.S. Pat. No. | Inventor | Issue Date |
|---|---|---|
| 4,512,567 | Phillips | Apr. 23, 1985 |
| 4,542,897 | Melton et al. | Sep. 24, 1985 |
| 4,637,605 | Richie | Jan. 20, 1987 |
| 4,976,435 | Shatford et al. | Dec. 11, 1990 |
| 5,591,104 | Andrus et al. | Jan. 7, 1997 |
| 5,645,513 | Haydocy et al. | Jul. 8, 1997 |
| 5,839,990 | Virkkala | Nov. 24, 1998 |

Phillips in U.S. Pat. No. 4,512,567 teaches an exercise bicycle along with a potentiometer which provides signals in proportion to the handlebar directional motion and speed of the bicycle. These signals interface with a microcomputer to operate a video game. The handlebars control side to side movement, up and down also forward and backward movement.

U.S. Pat. No. 4,542,897 issued to Melton et al. is for an exercycle combined with a video game. The handlebars control side to side movement and the grips up and down movement.

Richie in U.S. Pat. No. 4,637,605 discloses a video game control moving the handlebars. The arrangement can only be operated with a preset minimum exercise level.

Shatford et al. in U.S. Pat. No. 4,976,435 teaches an adapter for an exercise bicycle. The handlebars control side to side movement, up and down also the crank on the bicycle controls the speed on the video game.

Haydocy et al. in U.S. Pat. No. 5,645,513 discloses a physical exercise machine that interfaces with a video system. Movement of the pedals is indicated as speed on the video and other inputs such as pulse, heart rate etc. are indicated and recorded. The load resistance imposed by the video system.

U.S. Pat. No. 5,839,990 of Virkkala is for an exerciser combined with a video game computer allowing participation in the game dependent upon his rate of exercise and hand to eye coordination.

DISCLOSURE OF THE INVENTION

There have been developed many types of exercising devices that replicate the leg and body movement of riding a bicycle and are generically grouped into so called stationary or exercise bicycles. It is well established that users of exercise bicycles and other fitness devices, such as elliptical trainers and stepping machines, watch television or listen to music so as not to become bored during their workout. With the introduction, some years ago, of home computers and the internet, home and gym fitness enthusiasts began seeking solutions for electronic motivational workouts. A number of exercise bicycle manufacturers have enabled their equipment to port data signals to computers for the purpose of motivational interactive graphics and training logs. None, however, provide steering options which would allow an almost total simulation of the virtual cycling experience with video game control.

It is therefore a primary object of the invention to provide realistic true resistance when steering in a 3D virtual reality environment which encourages exercising in the indoor stationary cycling discipline. In order to accomplish this object, a discrete device is used that interfaces with the stationary bicycle that includes spring loading which permits the handlebar to dampen the movement of motion while increasing the felt resistance. The resistance is sensed when the further the handlebar is turned the more difficult it is to rotate. Also the invention provides self centering of the handlebar since when the handlebar is unrestrained it automatically returns to the center, duplicating the feel and impression of riding a bicycle. This simulation duplicates the condition that when a rider removes his hands from the handlebars they re-center themselves to a neutral straight ahead position.

Another object of the invention is that the invention mechanically limits the range of motion of the handlebar so as not to over-steer which could potentially damage the device. The invention is also robust enough to compensate for the extreme amount of torque applied by the user during an exciting game sequence.

Still another object of the invention permits a potentiometer to be used in conjunction with an interactive computer or television video game which allows simulation of the direction the handlebars are moved which is interpreted by the microprocessor program in the computer or television set.

Another object of the invention is the versatility of the invention as it may be used not only with stationary exercising bicycle but also elliptical trainers and steppers etc.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
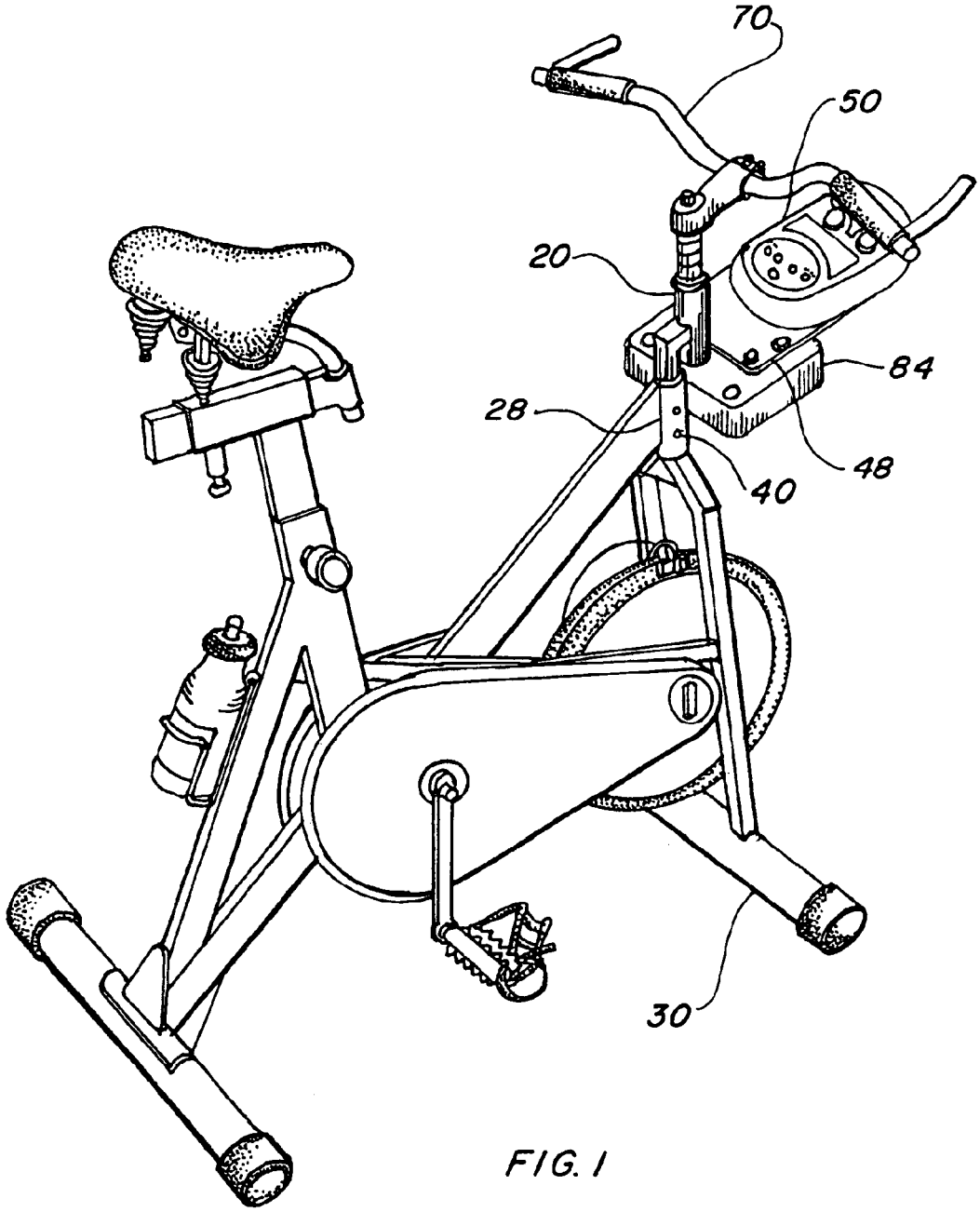
FIG. 1 is a partial isometric view of an exercise bicycle with the preferred embodiment of the steering mechanism mounted in place with a video game controller mounted on the steering mechanism utilizing its attachment bracket and the steering mechanism cover is installed.
Figure 2:
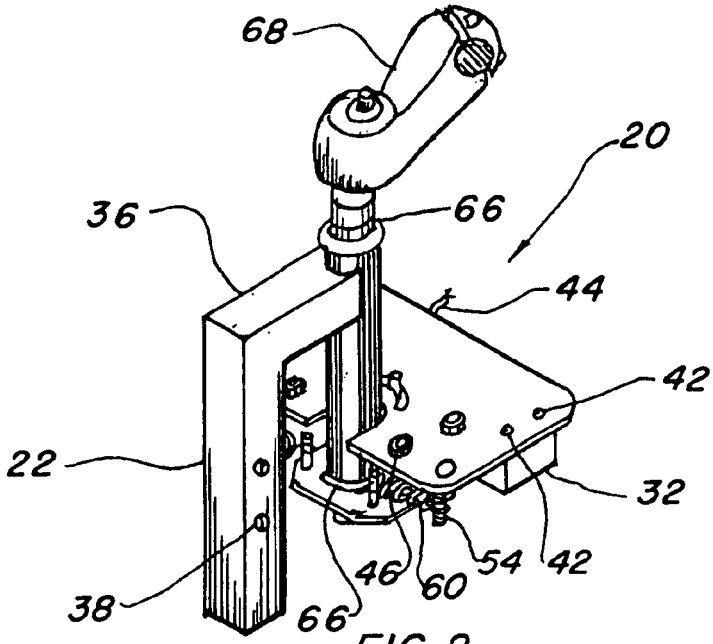
FIG. 2 is a partial isometric view of the steering mechanism, less cover, in the preferred embodiment.
Figure 3:
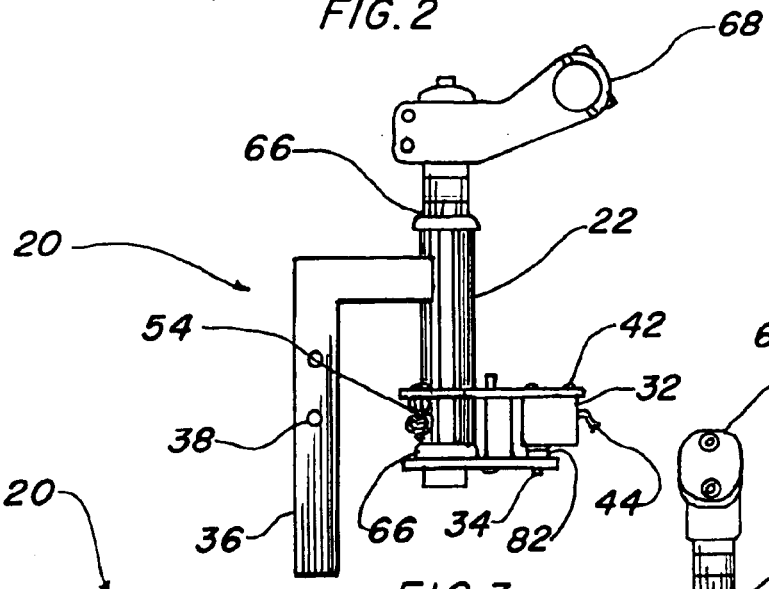
FIG. 3 is side elevation view of the preferred embodiment, less cover.

The best mode for carrying out the invention is presented in terms of a preferred embodiment. This preferred embodiment is for a steering apparatus that alters steering direction of an exercise bicycle used in conjunction with an interactive computer or television video game simulation. The invention is shown in FIGS. 1 thorough 15 and is comprised of a steering mechanism 20 consisting of a primary frame 22 which includes a steering tube 24 and a steering plate 26. The steering tube 24 is attached to a frame adapter which is contained within the frame head 28 of an exercise bicycle 30, as shown in FIG. 1.

Figure 6:
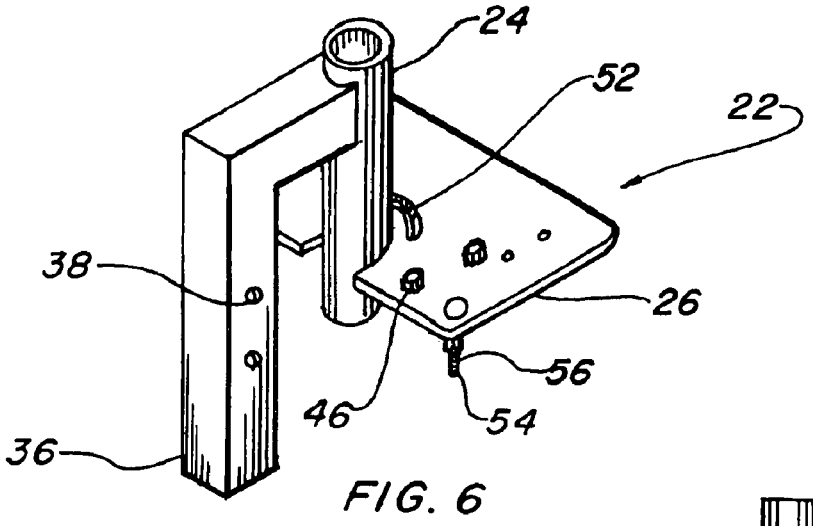
FIG. 6 is a partial isometric view of the steering mechanism primary frame, completely removed from the invention for clarity.
Figure 7:
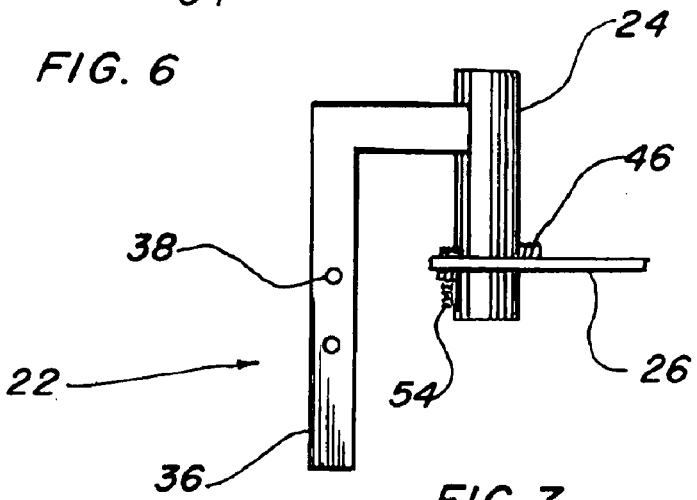
FIG. 7 is side elevation view of the steering mechanism primary frame, completely removed from the invention for clarity.
Figure 8:
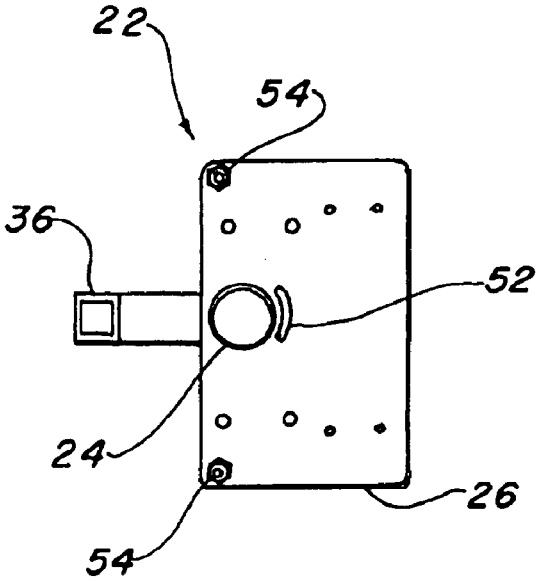
FIG. 8 is bottom view of the steering mechanism primary frame, completely removed from the invention for clarity.
Figure 9:
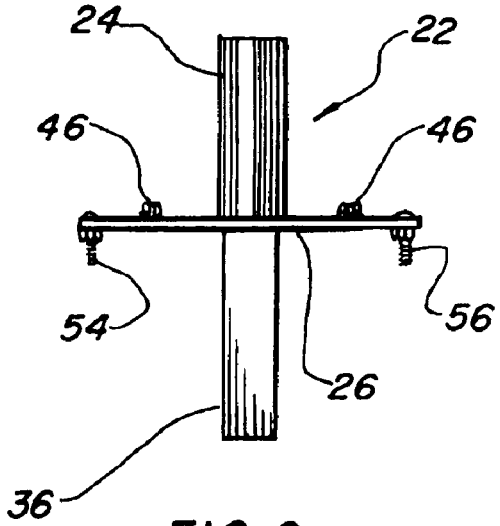
FIG. 9 is front view of the steering mechanism frame, completely removed from the invention for clarity.
Figure 10:
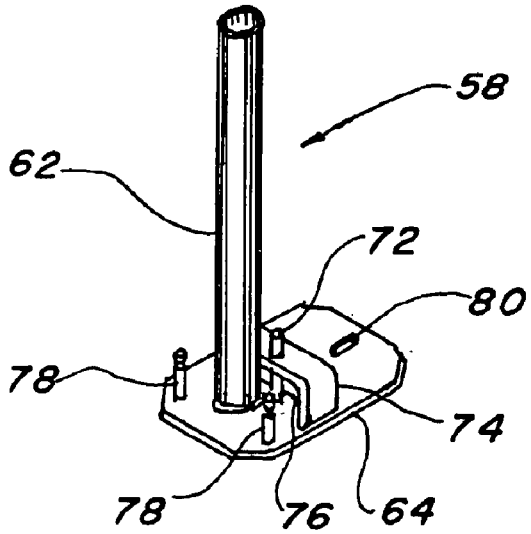
FIG. 10 is a partial isometric view of the steer frame, completely removed from the invention for clarity.
Figure 11:
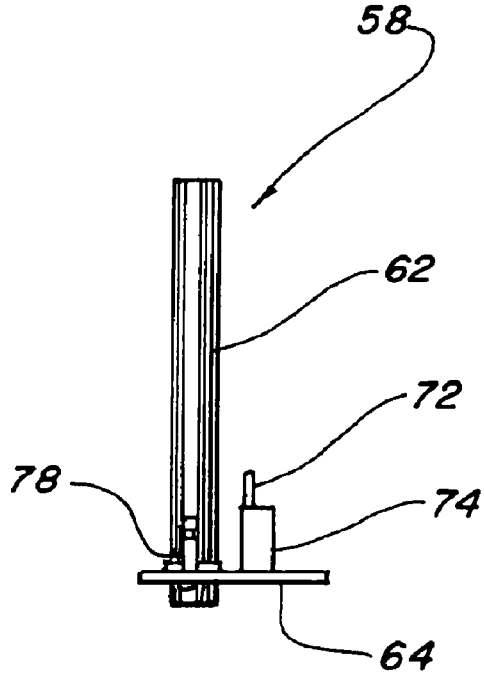
FIG. 11 is side elevation view of the steer frame, completely removed from the invention for clarity.
Figure 12:
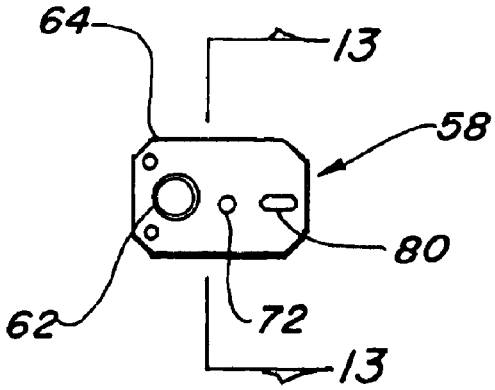
FIG. 12 is bottom view of the steer frame, completely removed from the invention for clarity.

The steering mechanism primary frame 22 includes an L-shaped frame adapter 36 that is welded, or rigidly attached, to the steering tube 24. This adapter 36 fits into the exercise bicycle frame head 28 as depicted in FIG. 1. While the adapter 36 is illustrated as a square tube, its shape may be round or may have a structural profile as long as it is compatible in size to fit inside the bicycle frame head 28. As illustrated in FIGS. 6 and 7, the adapter 36 includes a pair of holes 38 that interface with fasteners 40 in the frame head 28 of the exercise bicycle 30 and secure the adapter in place securely. Other methods of attachment are also contemplated and are well known in the art and in common usage.

The steering tube 24 is obviously hollow and is permanently attached to the shortest leg of the L-shape adapter 36 as illustrated in FIGS. 6–9. The steering tube duplicates the exercise bicycle frame head 28 and its utility is identical with the only difference is that its location is a little forward and slightly raised.

The steering plate 26 is also permanently attached the steering tube 24 just below the adapter 36 by welding, or the like, and is positioned at right angles to the tube 24. The steering plate 26 includes a potentiometer 32 mounted thereupon that is the linear type with an adjusting lever 34 extending downwardly in the middle. The potentiometer 32 is well known and is used in conjunction with the interactive computer or television video game providing a steering direction signal. The potentiometer 32 is attached to the steering plate 26 with conventional machine screws and locknuts 42 and includes electrical leads in the form of a 3 conductor cable 44, or the like. It will be noted at this point that while the use of a linear potentiometer is preferred a round rotational device will function equally well and has been anticipated to be an alternate approach in this invention.

The steering plate 26 further includes threaded holes 46 for attaching a mounting bracket 48 for a game controller 50 as illustrated in FIG. 1. These threaded holes 46 may be tapped, incorporate inserts or conventional nuts welded together to form a pedestal.

A radial slot 52 is located in the steering plate 26 near the steering tube 24 and two spring retainers 54 are positioned, one on each outside rear edge. The spring retainers 54 are simply posts that contain a groove 56 that may be studs, rods or carriage bolts as shown. The utility of these above elements will be discussed later in this specification.

A steer frame 58 is rotatably mounted within the steering mechanism primary frame 22 and has at least one spring 60 contiguously suspended between the primary frame 22 and the steer frame 58. While two springs 60 are preferred it is possible to use one torsion spring as an optional approach. When the exercise bicycle rider changes steering direction, by manual planar rotation of the handlebar attached to the steer frame 58, varying linear resistance is created within the potentiometer 32. When the handlebar is unrestrained the steer frame 58 returns to a centered position, duplicating the feel and impression of riding a bicycle.

The steer frame 58 is preferably fabricated as a weldment with a steer member 62 connected on one end to a potentiometer lever bracket 64 at a right angle thereunto. The steer frame 58 is illustrated by itself in FIGS. 10–14 with the steer member 62 a hollow metallic tube and the potentiometer lever bracket 64 a flat metal plate. The steer member 62 of the steer frame 58 is slightly longer than the steering tube 24 and small enough in diameter to slip inside without touching.

The steer frame 58 is held in place with a head set 66 similar to those used on a conventional bicycle, which affixes the steer member 62 rotatably within the primary frame steering tube 24. The head set 66 includes bearings that are pressed between the steering tube 24 and the steer member 62 on the top and bottom. The head set 66 utilizes a cone and crown on both top and bottom as well as spacers on the top. While the preferred embodiment utilizes a plain tubular steer member 62 it may be threaded and use the threaded version of the head set with equal ease.

A handlebar stem 68 is disposed within the steer member 62 of the steer frame 24 and a conventional handlebar 70 is attached to the stem 68 as shown in FIG. 1. Any type of bicycle stem 68 may be used as the configuration is not essential to the invention only that it must securely attach the handlebars.

Figure 13:
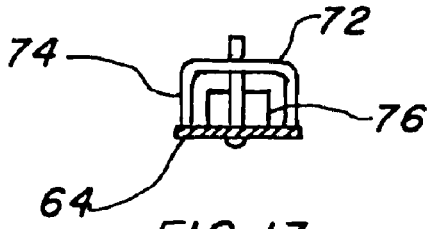
FIG. 13 is a cross sectional view taken along lines 13—13 of FIG. 12.
Figure 14:
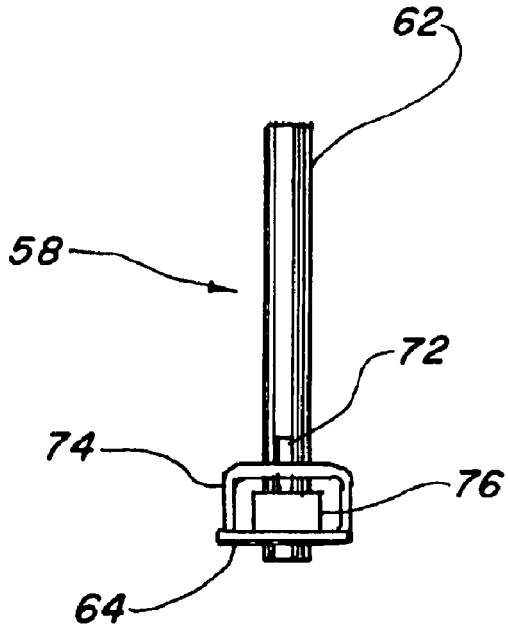
FIG. 14 is front view of the steer frame, completely removed from the invention for clarity.
Figure 15:
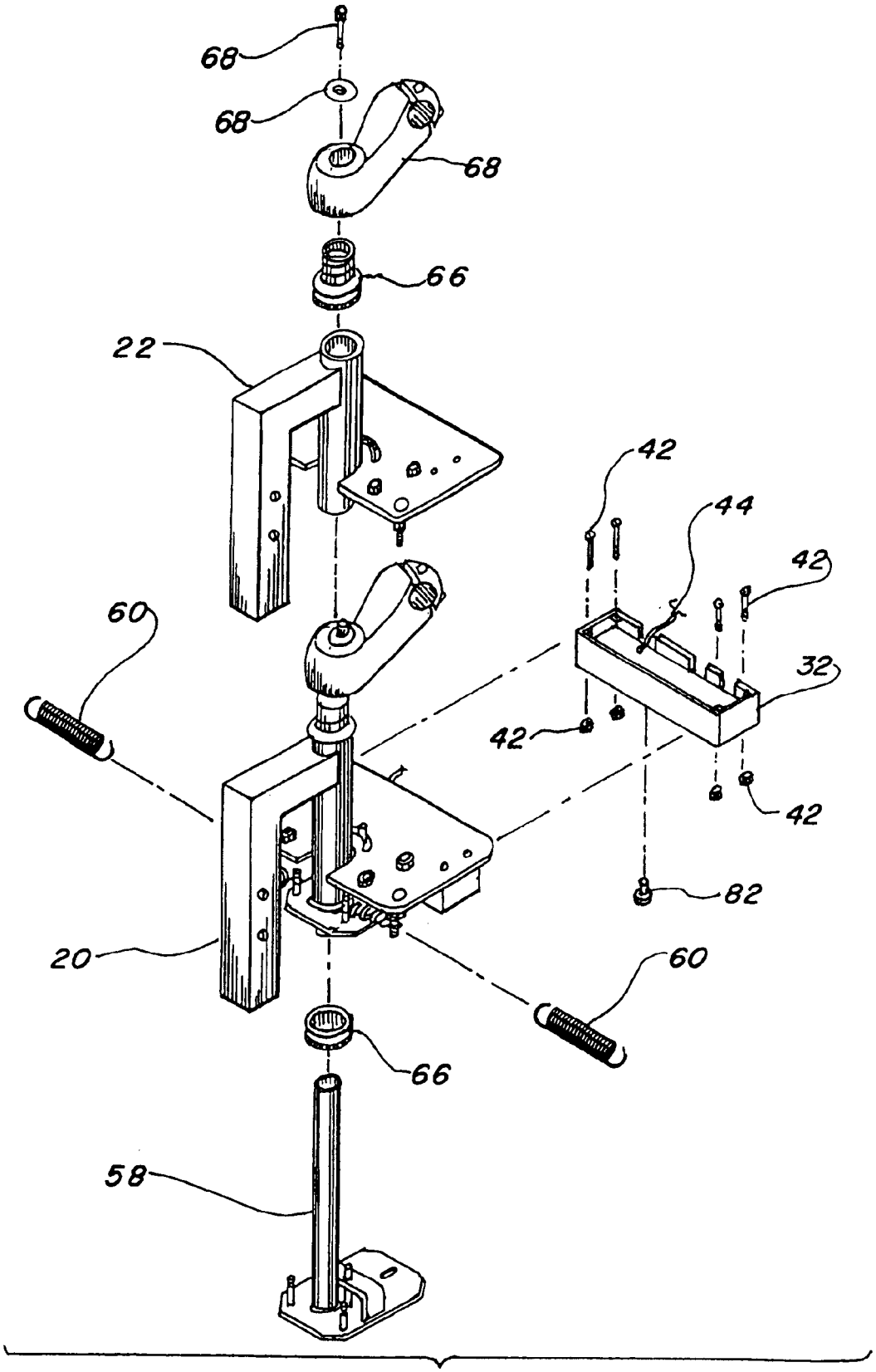
FIG. 15 is an exploded view of the steering mechanism, less cover, in the preferred embodiment.

The steering plate 26 includes the radial slot 52 therein while the steer plate potentiometer lever bracket 64 has a guide pin 72 extending upward therefrom with the guide pin 72 penetrating the slot 52 for limiting rotational travel between the primary frame 22 and the steer frame 58. Since rotation of the handlebars 70 is essential in some games to simulate steering and considerable leverage may be utilized to the user it has been found necessary to add a guide pin reinforcing yoke 74 and an optional reinforcing plate 76 for bracing and strengthening the guide pin 72. FIGS. 13 and 14 illustrate the strengthen members and there structural relationship.

Figure 4:
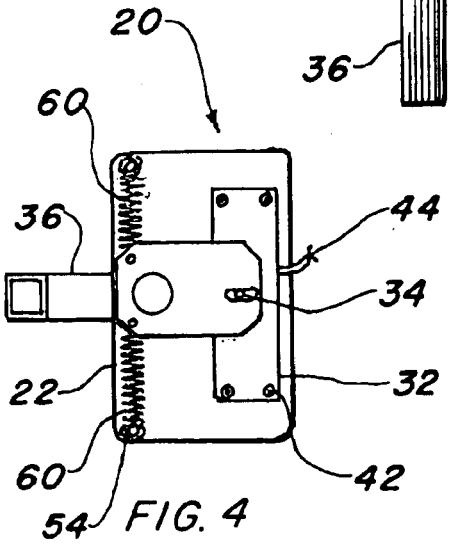
FIG. 4 is bottom view of the preferred embodiment, less cover.
Figure 5:
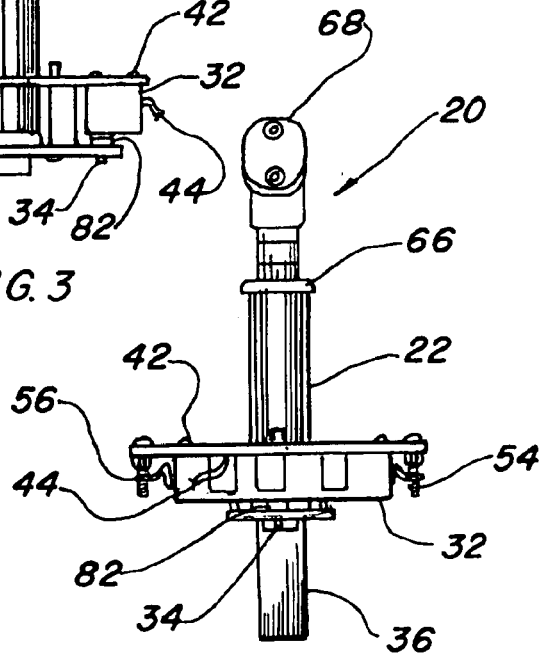
FIG. 5 is front view of the preferred embodiment, less cover.

The primary frame 22, as described above, has the pair of spring retainers 54 which are stationary and the steer frame potentiometer lever bracket 64 has a pair of mating spring holders 78 with each spring 60 fasten between the spring retainer 54 and the spring holder 78 best illustrated in FIG. 4. The preferred type of spring is an extension spring as it is contiguously suspended between the primary frame 22 and the steer frame 58 and increases resistance the further it is stretched while the opposed spring relaxes its force opposition. The springs 60 are biased in the center where each is stretched an equal amount. While two springs are shown and described the use of a torsion spring is also acceptable and could be a viable alternate as previously discussed.

The steer frame potentiometer lever bracket 64 contains a potentiometer lever slot 80 that is in alignment with the potentiometer adjusting lever 34. A potentiometer arm bushing 82 is slideably disposed within the potentiometer lever slot 80 interfacing with the potentiometer linear adjustment lever 34 permitting the potentiometer 32 to be adjusted throughout the axial travel of the potentiometer lever bracket 64 relative to the linear travel of the potentiometer lever 34.

A cover 84 encloses the bottom portion of the steering plate 26 including the steer frame 58 and springs 60. The cover 84 protects the exposed components from becoming a safety hazard.

If desired a lockout feature may be added to the invention which prohibits all handlebar steering motion. The steer member 62 may include a threaded hole and the steering tube 24 a nut welded on top of a clearance hole with a threaded knob inserted into the nut. When lockout is desired the threaded knob is screwed into and interfaces with the threaded hole in the steer member 62. Alternatively, this lockout feature may be accomplished by the use of a spring loaded system, passing a pin through both the steering tube 24 and the steer member 62 or any other equivalent method well known in the art.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

What is claimed is:

1. A steering apparatus for altering steering direction of an exercise bicycle that utilizes an interactive computer or television video game simulation, comprising, a steering mechanism primary frame, including a steering tube and a steering plate, said steering tube disposed within an exercise bicycle frame head, said steering plate having a potentiometer mounted thereupon, a steer frame rotatably mounted within the steering mechanism primary frame having at least one spring contiguously suspended between the primary frame and the steer frame such that changing steering direction by manual planar rotation of a handlebar attached to the steer frame creates progressively varying linear resistance, the steer frame returns to a centered position when unrestrained, duplicating the feel and impression of riding a bicycle, and said potentiometer interfacing with said rotatable steer frame providing variable electrical resistance relative to the directional movement of the steer frame to the primary frame, wherein an electrical signal transmitted from an interactive computer or television video game to the potentiometer interprets actual steering position.

2. The steering apparatus as recited in claim 1 wherein said steering mechanism primary frame further comprises an L-shaped frame adapter rigidly attached to an exercise bicycle frame head.

3. The steering apparatus as recited in claim 1 wherein said steer frame further comprises a steer member with a potentiometer lever bracket permanently attached at a right angle thereunto.

4. The steering apparatus as recited in claim 3 further comprising a handlebar stem disposed within the steer member of the steer frame and a handlebar attached to the stem.

5. The steering apparatus as recited in claim 4 further comprising a head set rotatably affixing the steer member within the primary frame steering tube.

6. The steering apparatus as recited in claim 1 wherein said primary frame steering plate having a radial slot therein and said steer plate potentiometer lever bracket having a guide pin extending therefrom with the guide pin penetrating the slot for limiting rotational travel between the primary frame and the steer frame.

7. The steering apparatus as recited in claim 6 wherein said guide pin further comprises an attached guide pin reinforcing yoke for bracing and strengthening the guide pin.

8. The steering apparatus as recited in claim 1 wherein said at least one spring contiguously suspended between the primary frame and the steer frame further comprise a pair of opposed extension springs.

9. The steering apparatus as recited in claim 8 further comprising said primary frame having a pair of spring retainers and said steer frame having a pair of spring holders wherein each extension spring fasten between a spring retainer and a spring holder.

10. The steering apparatus as recited in claim 1 wherein said steer frame potentiometer lever bracket having a potentiometer lever slot therein in alignment with said potentiometer.

11. The steering apparatus as recited in claim 10 further comprising a potentiometer arm bushing slideably disposed within said potentiometer lever slot wherein said potentiometer having an adjusting lever interfacing with the potentiometer linear adjustment lever permitting the potentiometer to be adjusted throughout the axial travel of the potentiometer lever bracket relative to the linear travel of the potentiometer adjusting lever.

12. The steering apparatus as recited in claim 1 further comprising a cover enclosing the steering plate bottom portion including the steer frame and springs.

13. A steering apparatus for altering steering direction of an exercise bicycle that utilizes an interactive computer or television video game simulation, comprising, means for rigidly mounting a potentiometer to an exercise bicycle frame head, a steer frame rotatably mounted into said potentiometer mounting means, said steer frame having spring loading changing steering direction by manual planar rotation of a handlebar attached to the steer frame creates progressively varying linear resistance, the steer frame while the steer frame returns to a centered position when unrestrained, duplicating the feel and impression of riding a bicycle, and means for potentiometer interfacing with said steer frame providing variable electrical resistance relative to the directional movement of the steer frame to the primary frame, wherein an electrical signal transmitted from an interactive computer or television video game to the potentiometer interprets actual steering position.

14. A steering apparatus for altering steering direction of an exercise bicycle that utilizes an interactive computer or television video game simulation comprising, a steering mechanism primary frame, disposed within an exercise bicycle frame head, said steering mechanism having a potentiometer mounted thereupon, a steer frame rotatably mounted within the primary frame having spring loading wherein changing steering direction by manual planar rotation of a handlebar attached to the steer frame creates progressively varying linear resistance, the steer frame while the steer frame returns to a centered position when unrestrained, duplicating the feel and impression of riding a bicycle, and said potentiometer interfacing with said steer frame providing variable electrical resistance relative to the directional movement of the steer frame to the primary frame, wherein an electrical signal transmitted from an interactive computer or television video game to the potentiometer interprets actual steering position.

* * * * *